United States Patent [19]

Nadenoff

[11] 4,290,202

[45] Sep. 22, 1981

[54] CHAIN SAW GUARD

[76] Inventor: Glenn L. Nadenoff, 1074 Lynsue La., Pontiac, Mich. 48054

[21] Appl. No.: 132,899

[22] Filed: Mar. 24, 1980

[51] Int. Cl.[3] ..... B27B 17/00

[52] U.S. Cl. ..... 30/382

[58] Field of Search ..... 30/382, 392, 151, 286; 51/268, 269, 274; 56/307-309; 83/440.2; 144/251 R; 416/247 R, 247 A

[56] References Cited

U.S. PATENT DOCUMENTS

| | | | |
|---|---|---|---|
| 2,596,481 | 5/1952 | Hincks | 30/382 X |
| 3,344,818 | 10/1967 | Musgrove | 30/382 X |
| 3,380,493 | 4/1968 | Giroux | 30/382 |
| 3,414,026 | 12/1968 | Merz | 30/382 X |
| 3,754,328 | 8/1973 | Knerr | 30/382 |
| 3,808,684 | 5/1974 | Ludwig | 30/382 |

*Primary Examiner*—Jimmy C. Peters
*Attorney, Agent, or Firm*—Gifford, VanOphem, Sheridan & Sprinkle

[57] ABSTRACT

A chain guard for a chain saw comprising an interdigital frame structure is secured to the chain saw so as to extend above the top edge of the saw chain over substantially its entire length. The guard includes a pair of depending mounting legs adjustably secured to a mounting block which is securely fastened to the handle of a conventional chain saw.

10 Claims, 3 Drawing Figures

CHAIN SAW GUARD

BACKGROUND OF THE INVENTION

I. Field of the Invention

The present invention relates generally to a guard extending over the blade chain of a chain saw and, more particularly, to such a guard which is releasably mounted to a forward handle mounted on the chain saw body and adjustable so that the height of the guard above the saw chain can be varied.

II. Description of the Prior Art

As is well known, chain saws include a saw bar projecting outwardly from a motor housing and an endless saw chain is rotatably entrained around the saw bar. The saw chain is necessarily exposed so that it can cut into and through tree limbs, logs and the like. However, only the lower portion of the saw chain adjacent the bottom of the saw bar cuts into the wood and thus, immediately embeds itself within the log. However, the portion of the saw chain along the upper portion of the saw bar remains exposed above the log until the depth of the cut exceeds the height of the saw bar. This exposure of the upper portion of the saw chain creates the risk that the chain saw operator or a co-worker can be severely injured when a portion of the body inadvertently contacts that portion of the saw chain. The risk of such contact is enhanced by the fact that rotation of the saw chain can cause the saw to jump out of the saw cut and toward the chain saw operator or a bystander.

Such risk has always been recognized, although little has been done to avoid such injurious contact other than making the motorized operation of the chain saw smoother and more predictable. Moreover, the use of a guard to protect the upper portion of the saw chain, while leaving the lower portion exposed in order to permit it to contact and cut into the log, has been considered impractical since the width of the saw cut precludes the use of a guard which is wider than the width of the chain when it is necessary to cut a log having a diameter greater than the height of the saw bar. One previously known saw chain guard is disclosed in U.S. Pat. No. 3,344,818 but is particularly designed to cover the saw chain only when the chain saw is not in use since it covers the entire saw chain and saw bar.

SUMMARY OF THE PRESENT INVENTION

The present invention overcomes the above-mentioned disadvantages by providing a chain saw guard which extends over the upper portion of the extending saw chain and saw chain bar and which is adjustable so that the saw is capable of cutting through a log having a diameter greater than the height of the saw bar. The guard generally comprises a substantially V-shaped rod having a plurality of projections extending between the legs of the V to form an interdigital guard or structure. The projections lie substantially within the plane of the legs of the V and are only slightly spaced apart from each other so that they form a virtual wall above the saw bar and prevent the saw chain from coming in contact with articles or body portions exposed to the saw chain from above.

The guard is supported above the saw bar by a pair of support legs which depend from the free ends of the V-shaped bar and are rigidly but adjustably secured to the handle mounted to the motor housing of the chain saw. The adjustable attachment of the support legs to the handle is accomplished by a mounting block having a recess adapted to engage a portion of the chain saw handle. The handle is secured within the recess in the block by means of a U-bolt slid around the handle and received in throughbores through the block. The threaded ends of the U-bolt are secured by nuts at the exposed end of the mounting block. The mounting block further includes a pair of perpendicular but intersecting throughbores which are both perpendicular to and spaced apart from the U-bolt receiving throughbores. Each support leg of the guard is slidably received in one of the two intersecting throughbores and is locked into position by a set screw. The support legs of the guard can be of any predetermined length and for particular applications can be trimmed so that they are able to fit a wide variety of chain saw handle configurations.

BRIEF DESCRIPTION OF THE DRAWING

The present invention will be more clearly understood by reference to the following detailed description of a preferred embodiment of the present invention when read in conjunction with the accompanying drawing in which like reference characters refer to like parts throughout the several views, and in which.

DETAILED DESCRIPTION OF A PREFERRED EMBODIMENT OF THE PRESENT INVENTION

Figure 1:
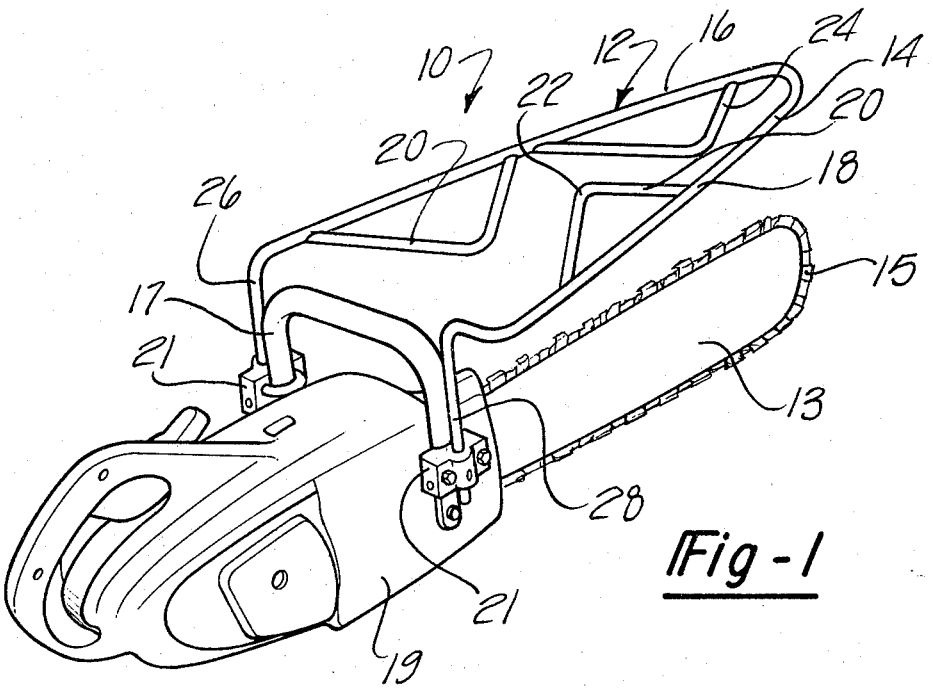
FIG. 1 is a perspective view of a preferred embodiment of a chain saw guard of the present invention secured to a chain saw.

Referring now to FIG. 1, the present invention 10 is thereshown comprising a guard structure 12 secured to a chain saw having motor housing 19 with a forward handle 17, an extended saw bar 13 and a saw chain 15 wrapped around the saw bar 13. The guard 12 comprises an elongated resilient metal rod 14 which is bent into substantially a V-shape to thereby form guard arms 16 and 18. The guard 12 includes a plurality of projections 20 to form a barrier between the arms 16 and 18. The guard 12 is secured to the chain saw 11 by means of the mounting blocks 21 in a manner to be described in detail hereinafter.

As shown in the preferred embodiment of the present invention illustrated in the drawing, the guard 12 includes three projections 20, 22 and 24 which are triangular in shape. Two projections 20 and 24 are secured to the arm 16 and extend toward the arm 18. The arm 18 includes a third projection 22 which extends toward the arm 16 in the interstice between the two projections 20 and 24 secured to the arm 16. The apices of the substantially V-shaped projections 20 and 24 remain spaced apart from the arm 18 and the apex of the substantially V-shaped projection 22 remains spaced apart from the arm 16 although the apices preferably extend at least as far as a bisection line between the arms 16 and 18. Thus, the projections 20, 22 and 24 provide an interdigital guard structure between the arms 16 and 18. Support legs 26 and 28 are formed at the free ends of the arms therefor 16 and 18, respectively, and depend downwardly therefrom although the free end of the arm 18 is curved toward the arm 16 at 29 near its free end for a purpose to be hereinafter described in detail. The support legs 26 and 28 are secured to the chain saw handle 17 by mounting blocks 21.

Figure 2:
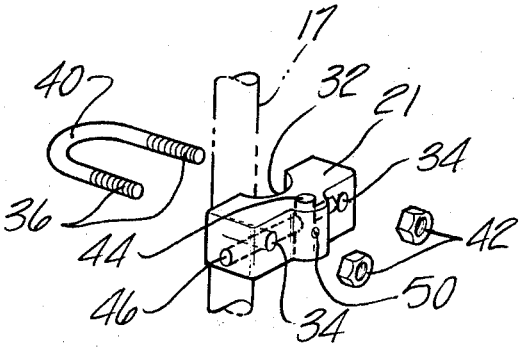
FIG. 2 is an exploded perspective view of the mounting block used to secure the guard to the handle of the chain saw.

As best shown in FIG. 2, the mounting block 21 is a substantially rectangular block having a semicylindrical recess 32 dimensioned to receive a portion of the semicylindrical handle 17. A pair of throughbores 34 perpendicular and adjacent to the recess 32 are adapted to receive the threaded shanks 36 of a U-bolt 40. The U-bolt 40 is slipped around the handle 17 and into the apertures 34 in the mounting block 21 so that the threaded ends 36 can extend outwardly from the block 21 and locked into position by the nuts 42. Thus, the handle 17 is tightly secured between the U-bolt 40 and the recessed wall of block 21.

The block 21 also includes throughbores 44 and 46 which intersect and are perpendicular to each other. The throughbore 44 is parallel to the recess 32 and both throughbores 44 and 46 are adapted to slidably receive a support leg 26 or 28 therein. A single set screw 50 is disposed in an appropriate threaded aperture which intersects both throughbores 44 and 46 so that regardless of which throughbore the support leg is inserted in, the single set screw 50 can be tightened against the support leg to lock it into position with respect to the mounting block 21 secured to handle 17. The support legs 26 and 28 are mounted to opposite ends of the handle 17 by a block 21 in substantially the same manner as described and thus, each connection need not be repeated here for the sake of brevity.

Figure 3:
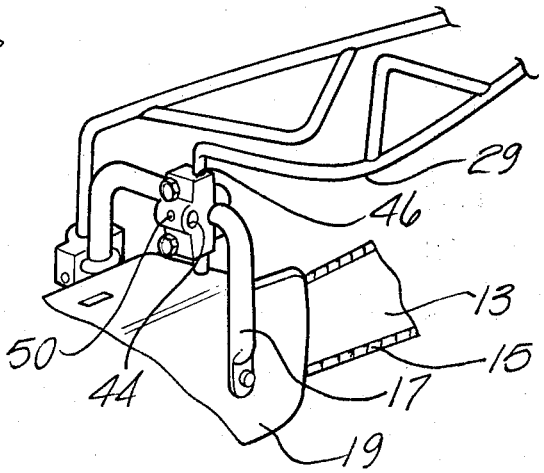
FIG. 3 is a fragmentary perspective view similar to FIG. 1, but showing a modification thereof.

Referring now to FIG. 3, a modification of the connection means is thereshown whereby one block 21 is secured to the horizontal portion of the handle 17. The support leg 28 the guard 12 is slidably received in the throughbore 46 and then locked into position by the set screw 50. Such a connection is required when the shape of the handle 17 or the shape of the motor housing 19 does not permit the U-bolt 40 to be slipped around the vertical portion of the handle 17. Nevertheless the curved portion 29 of the arm 18 permits the arm 18 to extend laterally away from the arm 16 an amount sufficient to provide a wide area of coverage above the saw chain 15. Although, as shown in FIG. 3, only one block 21 is mounted to the horizontal portion of the handle 17, it is to be understood that both mounting blocks can be so mounted. In that case, it is preferable to include a curved portion 29 in each leg 26 and 28.

Having thus described the important structural features of the present invention, the operation of the present invention is easily understood. The mounting blocks 21 are first secured to the handle 17 in the above described manner and in whichever position enables the U-bolt 40 to be slid around the handle 17 so that the nuts 42 can lock the block 21 tightly against the handle 17 with U-bolt 40. The preferred embodiment of the present invention shown in FIGS. 1 and 2 permits the legs 26 and 28 of the guard 12 to be inserted into the throughbores 44 of blocks 21 and locked into position with the set screw 50. This construction is especially advantageous since it permits the height of the arms 16 and 18 to be adjusted a predetermined amount above the upper portion of thesaw chain 15. Height adjustment of the bars 16 and 18 is easily accomplished by loosening the set screws 50 and sliding the support legs 26 and 28 within the apertures 44 of block 21.

Once the legs 26 and 28 have been lockingly engaged within the blocks 21, the projections 20, 22 and 24 prevent an object from entering between the arms 16 and 18 and contacting the upper portion of the saw chain 15. When the support legs 26 and 28 are disposed adjacent the sides of the motor housing 14, the arms 16 and 18 are spread apart a distance sufficient to provide a wide area of protection above the saw chain 15. In such a case, the curved portion 20 can be eliminated from the arms although the inclusion of such curved portions increases the area protected. Since the guard 12 is resilient, it can be urged away from the top of the saw chain 15 as the chain 15 cuts deeper into the log. Therefore, even when the diameter of the log to be cut slightly exceeds the height of the arms 16 and 18 above the bottom of saw chain 15, the saw bar 13 and chain 15 can be urged deeper into the cut while the guard 12 abuts against the top surface of the log. Nevertheless, when the cut has been completed, the guard returns to its predetermined position above the saw chain 15. When additional clearance between the blade and the guard is necessary, the height of the guard is easily adjusted by loosening the set screw 50 so that the support legs 26 and 28 can be slidably raised within the throughbores 44 and then retightened to secure the guard in position above the saw chain 15.

When it is necessary to mount a mounting block 21 above the motor housing 19 to the horizontal portion of handle 17 as shown in FIG. 3, the leg 28 can be cut short so that it can be positioned above the top of the motor housing 19. Although such a mounting structure somewhat limits an extent to which the guard can be raised above the top of the saw chain 15, the curve 29 in the arm 18 still permits the arm 18 to extend laterally away from the arm 16 to provide a wide area of protection above the saw chain 15. Nevertheless, the single set screw 50 lockingly secures the shortened leg 28 within the mounting block 21.

If desired, the projections 20, 22 and 24 can be provided with correspondingly shaped sheets of plastic or other material to further guard against articles entering through the interdigital structure of the guard and thereby preventing intrusion of fingers past the guard toward the top of the saw chain 15. Moreover, such panels can block sawdust which is thrown from the saw chain during cutting. Nevertheless, the addition of such panels does not effect the resilience or adjustability of the guard of the present invention.

Having thus described my invention, many modifications thereto will become apparent to those skilled in the art to which it pertains without departing from the scope and spirit as defined in the appended claims.

What is claimed is:

1. A detachable and adjustable chain saw guard for attachment to a chain saw having an extended saw bar around which the saw chain is driven by a motor, said motor being supported in a motor housing having a handle, said guard comprising:

first and second elongated rods;

a first means for connecting said rods together at one end such that the rods define a space therebetween;

a second means for releasably connecting the free ends of said rods to a chain saw such that the rods extend above and along the saw bar and saw chain; and a plurality of inwardly tapering projections, each projection being secured to at least one of said rods and extending from and between said rods substantially within the plane of said rods and wherein said projections are interspersed from side to side to thereby form an interdigital substantially planar frame structure above the saw bar and saw chain.

2. The invention as defined in claim 1 wherein said guard includes a third means for varying the space between said first and second rods.

3. The invention as defined in claim 1 wherein said first and second rods and said first means comprises an elongated rail return bent near its central portion to form a pair of elongated leg portions.

4. The invention as defined in claim 1 wherein said second means comprises a mounting post connected to the free end of each rod and extending outwardly from the plane defined by said rods, and third means for securing said mounting posts to said chain saw.

5. The invention as defined in claim 4 wherein said third means comprises an adapter block, said block having a pair of first apertures adapted to receive the legs of a U-bolt, a U-bolt dimensioned to fit over the handle of said chain saw, said block further comprising at least one second aperture dimensioned to slidably receive one of said mounting posts, and fourth means for locking said mounting post within said second aperture.

6. The invention as defined in claim 4 wherein at least one of said rods includes a curved portion near its free end whereby the space between said rods is wider than the distance between said mounting posts.

7. The invention as defined in claim 5 wherein said first and second apertures are throughbores and said mounting posts are elongated.

8. The invention as defined in claim 5 wherein said at least one second aperture comprises two apertures perpendicular to and intersecting each other, and said fourth means comprises a set screw aligned to engage each intersecting aperture.

9. The invention as defined in claim 5 wherein said block includes a recess intermediate said first apertures.

10. The invention as defined in claim 1 wherein said interdigital structure comprises a plurality of spaced apart interspersed triangular frame portions secured to and along said leg portions.

* * * * *